US005367097A

United States Patent [19]

Shen et al.

[11] Patent Number: 5,367,097

[45] Date of Patent: Nov. 22, 1994

[54] LUBRICANT COMPOSITION AND METHOD FOR INCREASING DIAMONDOID INCORPORATION IN POLYALPHAOLEFIN-CONTAINING LUBRICANT

[75] Inventors: Dong-Ming Shen, Langhorne, Pa.; Margaret M. Wu, Skillman, N.J.

[73] Assignee: Mobil Oil Corporation, Fairfax, Va.

[21] Appl. No.: 70,815

[22] Filed: Jun. 3, 1993

[51] Int. Cl.[5] ..... C07C 13/615

[52] U.S. Cl. ..... 585/22; 585/372; 585/375

[58] Field of Search ..... 585/352, 375, 22

[56] References Cited

U.S. PATENT DOCUMENTS

| | | | |
|---|---|---|---|
| 3,382,288 | 5/1968 | Schneider | 585/352 |
| 3,457,318 | 7/1969 | Capaldi et al. | 260/666 |
| 3,560,578 | 2/1971 | Schneider | 260/648 |
| 3,580,964 | 5/1971 | Driscoll | 260/871 |
| 3,639,362 | 2/1972 | Duling et al. | 260/78.5 |
| 3,649,702 | 3/1972 | Pincock et al. | 260/666 M |
| 3,676,521 | 7/1972 | Stearns et al. | 260/683.1 |
| 3,737,477 | 6/1973 | Stearns et al. | 260/683.15 D |
| 3,748,359 | 7/1973 | Thompson | 260/563 P |
| 3,832,332 | 8/1974 | Thompson | 260/78 R |
| 3,851,011 | 11/1974 | Stearns et al. | 260/683.15 D |
| 3,903,301 | 9/1975 | Share | 424/321 |
| 3,923,919 | 12/1975 | Stearns et al. | 260/683.1 |
| 3,928,480 | 12/1975 | Tabushi et al. | 585/352 |
| 3,966,624 | 6/1976 | Duling et al. | 252/52 R |
| 3,972,243 | 8/1976 | Driscoll et al. | 74/200 |
| 3,976,665 | 8/1976 | Feinstein et al. | 260/346.3 |
| 4,043,927 | 8/1977 | Duling et al. | 252/52 R |
| 4,082,723 | 4/1978 | Mayer et al. | 260/45.8 N |
| 4,142,036 | 2/1979 | Feinstein et al. | 528/183 |
| 4,168,260 | 9/1979 | Wiezer et al. | 260/45.8 NT |
| 4,182,922 | 1/1980 | Schick et al. | 585/18 |
| 4,239,927 | 12/1980 | Brennan et al. | 585/24 |
| 4,332,964 | 6/1982 | Bellmann et al. | 560/141 |
| 4,463,201 | 7/1984 | Schick et al. | 585/10 |
| 4,520,221 | 5/1985 | Chen | 585/517 |
| 4,547,613 | 10/1985 | Garwood et al. | 585/533 |
| 4,912,272 | 3/1990 | Wu | 585/10 |
| 5,043,503 | 8/1991 | Del Rossi et al. | 585/360 |
| 5,053,568 | 10/1991 | Chen | 585/21 |

OTHER PUBLICATIONS

*Adamantane, The Chemistry of Diamond Molecules,* Raymond C. Fort, Marcel Dekker, New York 1976.

*Primary Examiner*—Asok Pal

*Attorney, Agent, or Firm*—Alexander J. McKillop; Dennis P. Santini; Robert B. Furr, Jr.

[57] ABSTRACT

This invention provides a method for incorporating a diamondoid compound into a lubricant stock comprising reacting at least one α-olefin containing at least six carbon atoms with at least one diamondoid compound in the presence of an acid catalyst selected from the group consisting of $AlX_3$, $BX_3$, and $GaX_3$, wherein X is a halogen, together with at least one added proton-donating catalyst promoter.

The invention further provides a lubricant composition comprising alkyl-substituted diamondoids wherein the ratio of linear to branched alkyl substituents is at least about 4:1 and wherein the average number of alkyl substitutions per diamondoid molecule is from about 1.5 to about 4.

12 Claims, No Drawings

LUBRICANT COMPOSITION AND METHOD FOR INCREASING DIAMONDOID INCORPORATION IN POLYALPHAOLEFIN-CONTAINING LUBRICANT

CROSS-REFERENCE TO RELATED APPLICATIONS

This application is related by disclosure of similar subject matter to application Ser. No. 08/070,823 filed concurrently herewith.

FIELD OF THE INVENTION

The present invention relates generally to the field of high performance synthetic lubricants. More particularly, the invention relates to lubricant compositions and methods for synthesizing thermally and oxidatively stable lubricant compositions which exhibit high viscosity for a given molecular weight. The invention finds particular utility as a synthetic lubricant thickening agent, exhibiting unexpectedly high viscosity at relatively low molecular weight.

BACKGROUND OF THE INVENTION

Adamantane has been found to be a useful building block in the synthesis of a broad range of organic compounds. For a general survey of the chemistry of adamantane and the its higher homologs including diamantane and triamantane, see *Adamantane, The Chemistry of Diamond Molecules*, Raymond C. Fort, Marcel Dekker, New York, 1976. The following references provide a general overview of adamantane polymer chemistry.

U.S. Pat. No. 3,457,318 to Capaldi et al. teaches the preparations of polymers of alkenyl adamantanes and alkenyl adamantanes useful as coatings, electrical appliance housings, and transformer insulation. The process, yielding polymers bonded through the tetrahedral bridgehead carbons, comprises contacting an adamantyl halide in the presence of a suitable catalyst with a material selected from the group consisting of substituted allyl halides and olefins to produce adamantyl dihaloalkanes or adamantyl haloalkanes as an intermediate product. The intermediate product is then dehalogenated or dehydrohalogenated, respectively, to produce the alkenyl adamantane final product.

U.S. Pat. No. 3,560,578 to Schneider teaches the reaction of adamantane or alkyladamantanes with a $C_3$–$C_4$ alkyl chloride or bromide using $AlCl_3$ or $AlBr_3$ as the catalyst. The reference describes polymerization through $C_3$–$C_4$ linkages connecting bridgehead carbon atoms in the starting adamantane hydrocarbon; See column 3, lines 35–55, as well as the structural illustrations in columns 3–5.

U.S. Pat. No. 3,580,964 to Driscoll discloses polyesters containing hydrocarbyladamantane moieties as well as novel intermediate diesters and crosslinked polymers prepared therefrom. The hydrocarbyladamantane moieties are bonded through the tetrahedral bridgehead carbons; See column 2, lines 6–46 and the diesters illustrated in column 3, lines 55–75.

U.S. Pat. No. 3,639,362 to Dulling et al. discloses novel copolymers having low mold shrinkage properties which are prepared from adamantane acrylate and methacrylates. The adamantane molecule is bonded to the polymer chain through tetrahedral bridgehead carbon atoms.

U.S. Pat. No. 3,649,702 to Pincock et al. discloses a reactive derivative of adamantane, 1,3-dehydroadamantane. The reference shows bridgehead substituents including halogens and alkyls; See column 1, lines 45–64.

U.S. Pat. No. 3,748,359 to Thompson teaches the preparation of an alkyladamantane diamine from an alkyladamantane diacid. The diamine product is illustrated at column 1, lines 20–30, clearly showing bonding through the bridgehead carbons.

U.S. Pat. No. 3,832,332 to Thompson teaches a polyamide polymer prepared from an alkyladamantane diamine. As discussed and illustrated in the Thompson '332 patent at column 2, lines 41–53, the polymer comprises repeating units which include the backbone structure of adamantane. Note that the adamantane structure is bonded to the polymer chain through its bridgehead carbons.

U.S. Pat. No. 3,903,301 to Gates et al. teaches a limited-slip differential lubricant composition which may optionally include adamantane. See in particular the list of $C_{13}$–$C_{29}$ naphthenes at column 4, line 1 et seq.

U.S. Pat. No. 3,966,624 to Duling et al. teaches a power transmission fluid containing a saturated adamantane compound. The adamantane compound consists of adamantane-like structures connected through ester linkages, ether linkages, carboxylic acids, hydroxyl or carbonyl groups; See the Abstract as well as column 1, line 49 through column 2, line 50.

U.S. Pat. No. 3,976,665 to Feinstein et al. discloses a dianhydride containing an adamantane group bonded through the bridgehead carbons.

U.S. Pat. No. 4,043,927 to Duling et al. teaches a tractive drive which may optionally contain an alkyladamantane or alkyladamantanol dimer of the $C_{12}$–$C_{19}$ range containing from 1 to 3 alkyl groups of the $C_1$–$C_3$ range, wherein the dimer contains two adamantane nuclei which are linked together through an alkylene radical derived from and having the same number of carbon atoms as an alkyl group of the starting adamantane material.

U.S. Pat. No. 4,082,723 to Mayer et al. discloses azaadamantane compounds for stabilizing polymers to retard degradation by light and heat. The compounds have an adamantane backbone structure with at least one bridgehead carbon replaced by nitrogen. Specified bridgehead carbons may also be replaced by phosphorus, a phosphoryl or thiophosphcryi group, or a methine group optionally substituted by a phenyl or methyl group; See column 1, line 4 through column 2, line 16.

U.S. Pat. No. 4,142,036 to Feinstein et al. discloses adamantane compounds having 2 to 4 bridgehead positions substituted with phenylacyl moieties suitable for producing polymers useful for forming shaped objects such as film, fiber, and molded parts. The ester-substituted adamantanes are also suitable as plasticizers for polyvinylchloride and other polymers. The Feinstein et al. '036 patent notes that the four bridgehead carbons are equivalent to each other and are also more susceptible to attack than the secondary carbons.

U.S. Pat. No. 4,168,260 to Weizer et al. teaches nitrogen-substituted triaza-adamantanyl ureas useful as stabilizers for thermoplastic materials. Nitrogen replaces carbon in three of the four bridgehead positions.

U.S. Pat. No. 4,332,964 to Bellmann et al. discloses diacrylate and dimethacrylate esters containing bridegehead substituted adamantane monomers. The polymer synthesis technique disclosed at column 3, line 62 through column 7, line 61 includes halogen addition at bridgehead carbons followed by replacement of the halogen with the selected link of the polymer chain.

The following references are representative of the art of lubricant-grade synthetic oligomers.

U.S. Pat. Nos. 3,676,521, 3,737,477, 3,851,011, and 3,923,919 to Stearns et al. teach lubricants having high Viscosity Index, low pour point, and high stability which comprise ethylene-propylene copolymers produced from monoolefin mixtures containing ethylene and propylene over catalysts including vanadium-aluminum or titanium-aluminum Ziegler-type catalyst systems.

U.S. Pat. No. 3,972,243 to Driscoll et al. discloses compositions including traction fluids, antiwear additives, as well as lubricant stocks containing a gem-structured hydrocarbon backbone, which compositions are produced by ozonolysis of polyolefins, particularly polyisobutylene oligomers.

U.S. Pat. No. 4,182,922 to Schick et al. teaches a synthetic hydrocarbon oil and a method of making the same involving the copolymerization of propylene or propylene plus higher 1-olefins with small amounts of ethylene.

U.S. Pat. No. 4,239,927 to Brennan et al. relates to a process for producing synthetic hydrocarbon oils by the polymerization of olefins using an aluminum halide catalyst. More specifically, the reference provides a method for preventing accumulation of certain organic halides which were found to be corrosive to process equipment by reacting such organic halides with aromatic hydrocarbons to evolve an alkylation product.

U.S. Pat. No. 4,463,201 to Schick et al. discloses a process for producing high quality synthetic lubricating oils by the copolymerization of ethylene, propylene, and a third 1-olefin, and subsequently dewaxed via a urea adduction process.

U.S. Pat. No. 4,520,221 to Chen teaches a process for producing high Viscosity Index lubricants from light olefins over a catalyst having the structure of ZSM-5, the surface acidity of which has been inactivated by treatment with a suitable base material.

U.S. Pat. No. 4,547,613 to Garwood et al. teaches the conversion of olefin-rich hydrocarbon streams such as ethylene and containing up to about 16 carbon atoms to high Viscosity Index lubricant base stocks by contacting the olefins with a catalyst having the structure of ZSM-5 under elevated pressure.

U.S. Pat. No. 4,912,272 to Wu relates to lubricant mixtures having unexpectedly high viscosity indices. More specifically, the lubricant mixtures comprise blends of high Viscosity Index polyalphaolefins prepared with activated chromium on silica, polyalphaolefins prepared with BF3, aluminum chloride, or Ziegler-type catalysts.

The preceding references elucidate several advantageous aspects of synthetic lubricant, including high Viscosity Index, as well as good lubricity and thermal stability. Thus it would be highly desirable to provide a relatively low molecular weight high viscosity synthetic lubricant blending stock for increasing the kinematic viscosity of blended synthetic lubricants.

U.S. Pat. No. 5,043,503 to Del Rossi et al. teaches a process for alkylating polycycloparaffinic compounds (such as diamondoids) in the presence of zeolite catalysts to produce a lubricant stock.

U.S. Pat. No. 5,053,568 to Chen et al. teaches a lubricant additive and composition comprising the copolymer of 1-vinyladamantane and a 1-alkene.

SUMMARY OF THE INVENTION

This invention comprises, in a first aspect, a method for incorporating a diamondoid into a compound comprising reacting at least one α-olefin containing at least six carbon atoms with at least one diamondoid compound in the presence of an acid catalyst selected from the group consisting of $AlX_3$, $BX_3$, and $GaX_3$, wherein X is a halogen, together with at least one added proton-donating catalyst promoter.

This invention comprises, in a second aspect, a lubricant composition comprising alkyl-substituted adamantanes wherein the ratio of linear to branched alkyl substituents is at least about 1:1, preferably at least about 4:1, and wherein the average number of alkyl substitutions per diamondoid molecule is from about 1.5 to about 4. The lubricant composition of the invention is generally characterized by a Bromine Number (prior to hydrogentaion) of less than about 13, preferably less than about 5.

Feedstocks

Diamondoid compounds having at least one bridgehead hydrogen (i.e., at least one unsubstituted bridgehead position) are useful feedstocks in the present invention. The diamondoid feed may comprise a single diamondoid compound, or a mixture of diamondoid compounds.

The ratio of α-olefinic alkylating agent to the diamondoid compound ranges from about 20:1 to less than about 1:1, preferably from about 3:1 to about 1:1.

The alkyl-substituted diamondoid compounds are useful feedstocks with the limitation that the diamondoid backbone structure must contain at least one readily alkylatable reaction site. Further, the substituent groups surrounding the alkylatable reaction site or sites must be sufficiently small to avoid hindering the alkylation agent's access to the reaction site or sites. The substituent groups which may be present on the diamondoid feed compounds are preferably saturated hydrocarbons, and more preferably comprise essentially no unsaturated substituents. One example of an unsuitable feedstock component is 1-vinyl-adamantane.

Recovery of diamondoid compounds, one such class of polycyclic alkanes, from natural gas is detailed in U.S. Pat. Nos. 4,952,748, 4,952,749, 4,982,049, 4,952,747, 5,016,712, 5,126,274, 5,139,621 and 5,120,899, which patents are incorporated herein by reference for details of the recovery methods.

Generally the alkyl groups which can be present as substituents on the diamondoid compounds in the feedstock contain from 1 to about 30 carbon atoms and preferably from about 1 to 10 carbon atoms, and most preferably from about 1 to 5 carbon atoms.

Other suitable polycyclic alkane feedstocks include diamondoids such as adamantane, diamantane, and triamantane, as well as tricyclo[5.2.1.$0^{2,6}$] decane, norborane, bicyclo [2.2.2] octane, bicyclopentyl, bicyclohexyl, decahydronaphthalene, dicyclohexylmethane, perhydrofluorene, perhydroanthracene, dicyclohexylcyclohexane, and dicyclopentylcyclopentane. Higher molecular weight alkylhydroaromatic hydrocarbons can also be used as starting materials and include polycycloparaffinic hydrocarbons such as are produced by the alkylation of polycyclic paraffins with olefin oligomers. Examples of such products include butyl-tetralin, decyl-indan, dadecyl-fluorene, and dodecyl-anthracene.

The α-Olefin Alkylating Agents

The alkylating agents which are useful in the process of this invention generally include the α-olefins which contain at least six carbon atoms. The method of this invention selectively alkylates the diamondoid feed with the α-olefin or mixture of α-olefins. The α-olefins useful as alkylating agents may contain up to 40 or more carbon atoms, and α-olefins having from about 8 to about 20 carbon atoms are preferred. Examples of suitable α-olefins include 1-octene, 1-nonene, 1-decene, 1-undecane, 1-dodecene, 1-tridecene, 1-tetradecene, 1-pentadecene, 1-hexadecene, 1-heptadecene, and 1-octadecene. Alkylating agents such as alcohols (inclusive of monoalcohols, dialcohols, trialcohols, etc.) such as 1-octanol, 1-dodecanol, 1-decanol, 1-tetradecanal, 1-hexadecanol, 1,4-butanadiol, 1,8-octanediol; and, alkyl halides such as 1-chlorobutane, 1-chlorooctane, 1-chlorotetradecane, 1-bromodecane, and 1-bromohexadecane, are also useful for adding alkyl groups to diamondoid compounds, in the presence of the catalyst of this invention.

Mixtures of alpha-olefins are especially useful as alkylating agents in the alkylation process of this invention. Accordingly, mixtures of 1-octene, 1-nonene, 1-decene, 1-undecane, 1-dodecene, 1-tridecene, 1-tetradecene, 1-pentadecene, 1-hexadecene, 1-heptadecene, and 1-octadecene, are most preferred. For example, a typical mixed alpha-olefin stream preferred for use in the present process possesses the following composition:

| Alpha Olefin | Weight Percent |
|---|---|
| $C_6$ | 7 |
| $C_8$ | 10 |
| $C_{10}$ | 15 |
| $C_{12}$ | 13 |
| $C_{14}$ | 14 |
| $C_{16}$ | 9 |
| $C_{18}$ | 7 |
| $C_{20}+$ | 25 |

Catalysts

Catalysts useful for producing the lubricant of the present invention include metals as well as solid and liquid acidic catalysts, which are conventionally used for Friedel-Crafts reactions. Useful liquid acidic catalysts are exemplified by $BF_3$ complexes, as well as by a solution or complex of an aluminum halide, such as the chloride or bromide, which may be neat or which may be dissolved in a suitable solvent such as hexanes. The aluminum halide may be dissolved in a halogenated organic solvent, for example, a methylene halide such as methylene chloride or methylene bromide. The catalyst requires a promoter to achieve the dual purposes of the present invention: copolymerization of diamondoids and α-olefin monomer as well as self-polymerization of the α-olefin. For a discussion of liquid aluminum halide catalysts in synthetic lubricant synthesis from olefins, see U.S. Pat. No. 4,239,927 to Brennan et al., cited above, and incorporated by reference as if set forth at length herein.

Useful proton-donating additives include water, alcohols, and HX, where X is a halogen, merely to name a few. Examples of useful alcohols include methanol, ethanol, propanols, and butanols. Examples of useful additives having the formula HX include HF, HCl, HBr, and HI.

Conversion Conditions

Process conditions useful for synthesizing the lubricant additives of the present invention are shown below in Table 1.

TABLE 1

| | Conversion Conditions | |
|---|---|---|
| | Broad Range | Preferred Range |
| Temperature, °C. | −30–200 | 0–100 |
| Pressure, psig | 0–1000 | 0–300 |
| Contact Time, hrs. | 0.25–100 | 4–16 |
| Molar Olefin-to-Diamondoid Ratio | 40:1–1:1 | 4:1–1:1 |

The diamondoid feedstock of the invention may be produced by mixing individual diamondoid components, by blending mixtures of diamondoids, or by fractionating and treating a naturally occurring diamondoid mixture. U.S. Pat. No. 5,120,899 to Chen and Wentzek teaches a particularly preferred method for recovering a diamondoid-containing mixture from a natural gas stream, and is incorporated by reference as if set forth at length herein.

The lubricant base stock of the invention may be used neat or may be blended with a synthetic or petroleum-based lubricant stock. Examples of useful synthetic lubricant blending stocks are taught in U.S. Pat. Nos. 4,943,383 to Avery et al., 4,952,303 to Bortz et al., 4,962,249 to Chen et al., 4,967,029 to Wu, 4,967,032 to Ho et al., 4,990,709 to Wu, 4,990,718 to Pelrine, 4,990,238 to Cruzman et al., 4,992,189 to Chen et al., 4,995,962 to Degnan, Jr., et al., 5,012,020 to Jackson et 5,015,795 to Pelrine, 5,068,046 to Blain et al., and 5,095,165 to Hsia Chen. These patents are incorporated herein for teaching synthetic lubricant blending components.

EXAMPLES

Table 2 shows the compositions for four feedstocks used in the following Examples.

TABLE 2

Compositions of Diamondoid Mixtures Used in Allkylation Reactions (%)

| Compounds* | A Normally liquid Diamondoid Mixture | B Diamantanes+ Mixture | C Adamantanes Mixture | D Partially Liquid Diamondoid Mixture |
|---|---|---|---|---|
| adamantane | 1.364 | none | 1.234 | 8.535 |
| 1-methyl adamantane | 5.615 | none | 7.617 | 22.362 |
| 1,3-dimethyl adamantane | 6.070 | none | 10.174 | 16.552 |
| 1,3,5-trimethyl adamantane | 2.438 | none | 4.796 | 4.413 |
| 1,3,5,7-tetraamethyl adamantane | 0.413 | none | 0.713 | 0.428 |
| 2-methyl adamantane | 1.003 | none | 1.754 | 1.201 |
| t-1,4-Dimethyl adamantane | 1.514 | none | 2.980 | 0.803 |
| c-1,4-Dimethyl adamantane | 1.516 | none | 3.459 | 0.762 |
| 1,3,6-Trimethyl adamantane | 1.774 | none | 4.083 | 0.507 |
| 1,2-Dimethyl adamantane | 1.483 | | 3.368 | 0.753 |

TABLE 2-continued

Compositions of Diamondoid Mixtures Used in Allkylation Reactions (%)

| Compounds* | A Normally liquid Diamondoid Mixture | B Diamantanes+ Mixture | C Adamantanes Mixture | D Partially Liquid Diamondoid Mixture |
|---|---|---|---|---|
| 1r, 3,4t-Trimethyl adamantane | 2.056 | | 4.647 | 0.528 |
| 1r, 3,4c-Trimethyl adamantane | 2.117 | | 4.898 | 0.538 |
| 1,3,5,6-tetramethyl adamantane | 2.044 | | 5.308 | 0.311 |
| 1-ethyl adamantane | 0.630 | | 1.523 | 0.822 |
| 2,6-; 2e,4e-; 2e,4a-diMe Ad | 0.118 | | 0.285 | 0.036 |
| 1,2,3,5-tetramethyl | 0.07 | | 0.17 | |
| 1-ethyl-3-methyl adamantane | 2.16 | | 5.17 | 1.721 |
| 1,2,3-Trimethyl adamantane | 0.34 | | 0.81 | 0.064 |
| 1-ethyl-3,5-dimethyl adamantane | 1.582 | 0.012 | 3.909 | 0.881 |
| 1-ethyl-3,5,7-trimethyl adamantane | 0.424 | | 1.031 | 0.314 |
| 1,2,3,5,7-pentamethyl adamantane | 1.050 | 0.029 | 2.489 | 0.386 |
| Other adamantanes | 14.432 | 6.631 | 23.083 | 4.432 |
| Total adamantanes | 50.213 | 6.672 | 93.501 | 66.349 |
| Diamantane | 3.967 | 5.560 | 1.342 | 7.485 |
| 4-Methyl-diamantane | 5.345 | 8.338 | 1.522 | 6.277 |
| 4,9-Dimethyl-diamantane | 1.710 | 2.784 | 0.400 | 1.210 |
| 1-Methyl-diamantane | 3.343 | 5.664 | 0.624 | 3.275 |
| 2,4-Dimethyl-diamantane | 2.078 | 3.611 | 0.395 | 1.115 |
| 1,4-dimethyl diamantane | 2.563 | 4.509 | 0.406 | 1.24 |
| 1,4,9-trimethyl diamantane | 1.103 | 1.981 | 0.196 | 0.58 |
| 3-methyl diamantane | 2.384 | 4.241 | 0.359 | 0.649 |
| 4,8-Dimethyl diamantane | 1.618 | 2.970 | 0.195 | 0.251 |
| 4-Ethyl-diamantane | 0.584 | 1.206 | 0.043 | 0.124 |
| Other diamantanes | 16.597 | 34.282 | 1.017 | 3.542 |
| Total diamantanes | 41.292 | 75.146 | 6.499 | 25.748 |
| Triamantane | 1.175 | 2.608 | 0.017 | 0.496 |
| 9-methyl triamantane | 1.151 | 2.583 | 0.016 | 0.264 |
| 9,15-dimethyl triamantane | 0.233 | 0.521 | | 0.039 |
| 3-Me & 3,9-diMe triamantanes | 0.696 | 1.560 | | 0.086 |
| 7,9-diMe & 3,9,15-triMe triamantanes | 0.489 | 1.136 | | 0.060 |
| 4-Me & 4,9,15-triMe triamantanes | 0.440 | 0.973 | | 0.044 |
| 4,9- & 6,9-dimethyl triamantanes | 0.184 | 0.419 | | 0.019 |
| 5-methyl triamantane | 0.289 | 0.661 | | 0.015 |
| 5,9-methyl triamantane | 0.180 | 0.395 | | 0.009 |
| 8-Me & 5,9,15-triMe triamantanes | 0.244 | 0.585 | | |
| 9,14-dimethyl triamantanes | 0.144 | 0.238 | | |
| 8,9-dimethyl triamantanes | 0.069 | 0.210 | | |
| 16-methyl-, a dime- & a trime- triamantanes | 0.366 | 0.837 | | |
| 2-methyl triamantane | 0.118 | 0.302 | | |
| other triamantanes | 1.857 | 4.402 | | 0.050 |
| Total triamantanes | 7.605 | 17.430 | 0.033 | 1.082 |
| iso-tetramantane + A + B | 0.119 | 0.283 | | — |
| anti-tetramantane | 0.023 | 0.059 | | — |
| other tetramantanes | 0.139 | 0.410 | | |
| Total tetramantane | 0.281 | 0.752 | 0.000 | — |

¶ This sample contained 6.821% of lower boiling materials.

*Prefixes a-, e-, c-, and t- refer to axial, equatorial, cis-, and trans- relationship of substituents in the same cyclohexane ring bearing the substituents in the diamondoids.

Examples 1–12

Experimental Procedures: In typical experiments, the starting diamondoids were heated in a flask fitted with a reflux condenser having a nitrogen bubbler, a pressure-equalized addition funnel containing the α-olefin, and a thermocouple for temperature monitoring and/or control. After reaching the predetermined temperature, typically about 50° to 70° C., catalyst was added (anhydrous $AlCl_3$ or $AlBr_3/CH_2Br_2$), followed by the gradual addition of 1-decene to the flask with stirring. The temperature of the reaction mixture was controlled by the rate of addition, and heating/cooling. After finishing addition, the reaction mixtures were heated for an additional period, typically several hours. Aqueous work-up gave the crude products. Distillation to remove low-boiling products and unreacted diamondoids gave the lube products. The latter were hydrofinished at about 500 psi and about 200° C. with 1 wt. % Ni/-$SiO_2$ catalyst for about 5–15 hours, resulting in the final hydrofinished products.

Examples 1–9

Examples 1–9 show the reaction of diamondoids with α-olefins in the presence of $AlCl_3$. The term "% D-H" in Table 3 represents the weight percent of diamondoids in the lube products, estimated by mass balance and GC analysis. Lube yield is defined as the weight % of product versus the total weight of the diamondoids and α-olefins. In Example 2, the feed was hydrotreated before the reaction with the α-olefin.

TABLE 3

The reaction of diamonoids with Alpha-olefins using $AlCl_3$ as catalyst

| Ex. | Diamondoids | | | α-Olefin used | | | $AlCl_3$ | During olefin addn. | | After olefin addn. | | Crude Lube Product | | | |
|---|---|---|---|---|---|---|---|---|---|---|---|---|---|---|---|
| # | fraction | g | % conv | Cpd | g | % conv. | g | Temp. °C. | hrs | Temp. °C. | hrs | g | % yield | % D-H | $Br_2$ # |
| 1 | C | 175 | 19 | C10 | 140 | 98 | 3.0 | 48–78 | 1.2 | 50 | 4.5 | 148 | 47 | 16 | 9.8 |
| 2 | B¶ | 125 | 34 | C10 | 210 | 92 | 5.6 | 50–65 | 3.0 | 50 | 4.3 | 224 | 67 | 19 | 11.6 |
| 3 | B | 125 | 25 | C10 | 140 | 98 | 5.3 | 48–90 | 1.7 | 50 | 2.0 | 158 | 60 | 20 | 9.1 |
| 4 | B | 125 | 21 | C10 | 140 | 98 | 3.9 | 48–122 | 2.1 | 50 | 2.0 | 151 | 57 | 17 | 12.6 |
| 5 | B | 125 | 21 | C10 | 140 | 98 | 3.9 | 62–79 | 1.9 | 65 | 2.0 | 157 | 59 | 17 | 12.0 |
| 6 | B | 125 | 11 | C10 | 140 | 95 | 3.9 | 48–68 | 2.0 | 50 | 2.0 | 132 | 50 | 10 | — |
| 7 | A | 150 | 15 | C10 | 140 | 99 | 3.0 | 49–72 | 1.3 | 50 | 4.4 | 121 | 42 | 19 | 10.9 |
| 8 | A | 150 | 9 | C14 | 196 | 80 | 4.0 | 62–75 | 1.2 | 60 | 3.1 | 173 | 50 | 5 | 7.2 |
| 9 | A | 96 | 18 | C14 | 96 | 89 | 2.2 | 59–70 | 0.9 | 61–66 | 3.5 | 97 | 51 | 18 | 6.9 |

The properties of the products of Examples 1–9 are shown below in Table 4. The lubricant product initial boiling point (designated as "Lube b.p.≧" in Table 3) was determined by distilling the crude products to remove unreacted starting materials and low-boiling products at the specified pot temperature and vacuum for several hours.

Examples 10, 11, and 12 are commercial polyalphaolefin (PAO) lubricant base stocks and are presented for comparison.

TABLE 4

Properties of hydrofinished lube products from diamonoids with Alpha-olefins using $AlCl_3$ as catalyst

| Example | Viscosity, cS | | | Pour Point | | Lube b.p. ≧ | Thermal stability under nitrogen | | | |
|---|---|---|---|---|---|---|---|---|---|---|
| | | | | | | | % viscosity change, 100° C. | | % weight loss | |
| Number | 100° C. | 40° C. | VI | °C. | $Br_2$ # | (°C./mm-Hg) | 300° C./24 hr | 288° C./72 hr | 300° C./24 hr | 288° C./72 hr |
| 1 | 13.69 | 114.9 | 117 | −45.8 | 1.5 | 152/0.06 | −7.7 | −13.4 | 2.3 | 0.6 |
| 2 | 20.76 | 192.4 | 127 | −41.6 | 2.9 | 142/0.095 | −20.7 | −28.4 | 1.3 | 0.9 |
| 3 | 18.41 | 174.9 | 117 | −40.3 | 1.4 | 170/0.16 | −4.8 | −10.0 | 0.7 | 0.7 |
| 4 | 12.99 | 106.4 | 118 | −46.0 | 1.6 | 212/0.25 | −10.9 | −12.2 | 3.1 | 0.5 |
| 5 | 13.87 | 117.2 | 117 | −45.1 | 1.9 | 150/0.20 | −3.7 | −6.1 | 2.4 | 1.2 |
| 6 | 19.50 | 184.5 | 121 | −40.5 | 0.3 | 150/0.1 | −15.0 | −21.7 | 2.7 | 0.7 |
| 7 | 21.67 | 221.8 | 117 | −38.6 | 1.3 | 167/0.16 | −16.7 | −19.8 | 2.1 | 0.7 |
| 8 | 18.03 | 142.2 | 141 | −9.1 | −0.2 | 110/0.29 | −22.4 | −16.3 | 0.6 | 0.5 |
| 9 | 20.56 | 182.3 | 132 | −8.8 | 0.5 | 119/0.84 | −11.4 | −9.4 | 0.3 | 1.1 |
| 10 | 5.59 | 29.46 | 131 | −5.4 | — | — | −12.9 | −25.0 | 1.9 | 2.6 |
| 11 | 20.8 | — | 142 | — | — | — | — | — | — | — |
| 12 | 39.11 | 393.0 | 148 | −38.3 | — | — | −44.9 | −30.2 | 10.7 | 5.9 |

Examples 13–25

Examples 13–25 show the reaction of diamondoids with 1-decene with $AlCl_3$—$H_2O$ catalyst. Lube yield (designated as "% yield" in Table 5) represents the weight % of product versus the total weight of the diamondoids and 1-decene feed. The term "% D-H" represents the weight % of diamondoids in the lube products, estimated by mass balance and GC analysis.

The diamondoid feeds for Examples 15–19 were pretreated with activated alumina to remove colorants. The diamondoid feed in Example 16 was also hydrotreated. The feed in Example 21 contained recovered adamantanes from Examples 1 and 20, including small amounts of decene dimers and decyl adamantanes. The diamondoid feed used in Example 23 differed slightly in composition from that of Example 20. The diamondoid feed for Example 24 contained a portion of the low-boiling material from Examples 14–19 and contained about 60% diamondoids, 11% decenes, 6% decene dimers, and 22% decyl diamondoids based upon GC integration areas. The feed for Example 25 contained low-boiling materials from Example 24 including 53% diamondoids, 17% decenes, 8% decene dimers, and 22% decyl diamondoids based on GC. A portion of the $AlCl_3$ was added in the middle of the 1-decene addition.

TABLE 5

The reaction of diamonoids with 1-decene using $AlCl_3$—H2O as catalyst

| Ex. | $H_2O$ | Diamondoids | | | 1-decane used | | $AlC_3$ | During olefin addn. | | After olefin addn. | | Crude Lube Product | | | |
|---|---|---|---|---|---|---|---|---|---|---|---|---|---|---|---|
| No. | g | fraction | g | % conv. | g | % conv. | g | Temp. °C. | hrs | Temp. °C. | hrs | g | % yield | % D-H | $Br_2$ # |
| 13 | 0.00 | A | 301 | 10 | 301 | 95 | 10.0 | 40–49 | 3.5 | 38–44 | 5 | 293 | 48 | 10 | — |
| 14 | 0.50 | A | 300 | 74 | 300 | 95 | 10.0 | 40–51 | 8.0 | 40 | 10 | 449 | 75 | 40 | 2.2 |
| 15 | 0.50 | A | 300 | 75 | 300 | 95 | 10.0 | 37–51 | 1.8 | 37–42 | 5.5 | 443 | 74 | 47 | 2.2 |
| 16 | 0.52 | A | 300 | 56 | 300 | 99 | 10.3 | 41–52 | 1.7 | 38–43 | 5.7 | 433 | 72 | 38 | 3.4 |
| 17 | 0.40 | A | 200 | 63 | 300 | 98 | 8.0 | 40–47 | 1.6 | 40–44 | 5.9 | 378 | 76 | 32 | 2.8 |
| 18 | 1.10 | A | 700 | 74 | 700 | 93 | 21.0 | 41–46 | 5.1 | 39–41 | 7.5 | 1090 | 78 | 45 | 2.2 |
| 19 | 0.25 | A | 200 | 74 | 200 | 95 | 5.7 | 78–89 | 0.8 | 80 | 5.3 | 275 | 69 | 43 | 3.7 |
| 20 | 0.50 | C | 300 | 68 | 300 | 98 | 10.3 | 38–47 | 1.8 | 39–42 | 5.7 | 346 | 58 | 45 | 2.8 |
| 21 | 1.40 | C | 1249 | 67 | 1150 | 94 | 28.4 | 38–49 | 4.5 | 38–42 | 6.5 | 1639 | 68 | 40 | 2.6 |
| 23 | 0.30 | C | 150 | 88 | 300 | 97 | 7.1 | 45–54 | 2.7 | 45–47 | 9.5 | 334 | 74 | 29 | 2.0 |
| 24 | 0.75 | A | 802 | 54 | 500 | 85 | 19.5 | 43–52 | 2.9 | 41–49 | 13 | 742 | 57 | 27 | 1.7 |

TABLE 5-continued

| The reaction of diamonoids with 1-decene using $AlCl_3$—H2O as catalyst | | | | | | | | | | | | | | | |
|---|---|---|---|---|---|---|---|---|---|---|---|---|---|---|---|
| | | Diamondoids | | | 1-decane used | | | During olefin addn. | | After olefin addn. | | Crude Lube Product | | | |
| Ex. No. | $H_2O$ g | fraction | g | % conv. | g | % conv. | $AlCl_3$ g | Temp. °C. | hrs | Temp. °C. | hrs | g | % yield | % D-H | $Br_2$ # |
| 25 | 0.40 | A | 515 | 43 | 300 | 82 | 18.2 | 48–56 | 1.9 | 46–54 | 11 | 364 | 45 | 30 | 3.9 |

Table 6 shows the properties of the lubricant basestocks of Examples 13–25 after hydrofinishing in the presence of a commercial hydrotreating catalyst. Before the hydrogenation step, the crude products were vacuum distilled to remove unreacted starting material and low-boiling products using a 12" Vigreaux column and a Normag distillation apparatus at temperatures up to the boiling points specified in Table 6.

The material of Example 22 was obtained by distilling the hydrogenated product from Examples 20 and 21.

TABLE 6

| Properties of hydrofinished lube products from diamondoids with Alpha-olefins using $AlCl_3$—$H_2O$ as catalyst | | | | | | | | | | |
|---|---|---|---|---|---|---|---|---|---|---|
| Example | Viscosity, cS | | | Pour Point | | Lube b.p. ≧ | Thermal stability under nitrogen | | | |
| | | | | | | | % 100 C. viscosity change | | % weight loss | |
| Number | 100° C. | 40° C. | VI | °C. | $Br_2$ # | °C./mm-Hg | 300° C./24 hr | 288° C./72 hr | 300° C./24-hr | 288° C./72 hr |
| 13 | 19.64 | 180.7 | 125 | −43.4 | 1.0 | 166/1.06 | — | −36.9 | — | 1.6 |
| 14 | 14.28 | 153.4 | 89 | −36.8 | 1.3 | 160/0.78 | — | −5.4 | — | 0.9 |
| 15 | 14.20 | 150.5 | 91 | −39.6 | 1.2 | 155/1.24 | — | +0.1 | — | 1.3 |
| 16 | 14.07 | 132.0 | 104 | −41.0 | 1.1 | 156/0.91 | — | −8.7 | — | 4.7 |
| 17 | 17.31 | 175.6 | 106 | −39.8 | 1.2 | 146/0.63 | — | −7.2 | — | 0.7 |
| 18 | 13.89 | 144.6 | 92 | −39.8 | 0.6 | 155/0.82 | −0.8 | +3.2 | 0.5 | 2.0 |
| 19 | 15.89 | 181.3 | 89 | −37.2 | 0.9 | 171/0.81 | −1.7 | +0.9 | 0.6 | 1.3 |
| 20 | 12.38 | 114.8 | 98 | −44.9 | 0.9 | 158/0.61 | — | −13.9, 7.8 | — | 2.5, 2.1 |
| 21 | 10.24 | 86.32 | 99 | <−46.1 | 0.1 | ~153/0.70 | −3.3 | −2.6 | 0.7 | 1.3 |
| 22 | 14.44 | 145.4 | 97 | −40.0 | 0.4 | 164/0.65 | — | +2.9 | — | 4.6 |
| 23 | 17.65 | 182.7 | 105 | −43.1 | 0.5 | 175/0.80 | — | −5.7 | — | 1.2 |
| 24 | 13.66 | 124.0 | 107 | −42.9 | 0.9 | 154/0.38 | — | −15.4 | — | 1.7 |
| 25 | 19.54 | 217.6 | 102 | −37.2 | 0.7 | 174/0.88 | — | −15.0 | — | 4.4 |
| 10 | 5.59 | 29.46 | 131 | −54 | — | — | −12.9 | −25.0 | 1.9 | 2.6 |
| 11 | 20.8 | — | 142 | — | — | — | — | — | — | — |
| 12 | 39.11 | 393.0 | 148 | −38.3 | — | — | −44.9 | −30.2 | 10.7 | 5.9 |

*Before hydrogenation, crude products were distilled to remove unreacted starting material and low-boiling products using a 12" Vigreux column and a Normag distilling apparatus up to the boiling points specified in the table.
[a]Obtained from distillation of hydrogenated product from Examples 20 and 21.

Examples 26–30

Examples 26–30 illustrate the reaction of diamondoids with 1-decene using $BF_3$—PrOH as the catalyst. The results are summarized in Table 6 and 7. The data show high diamondoid conversion with $BF_3$—PrOH. In cases of low diamondoid conversion, the bromine number of the crude lube product approached the bromine number of the product from pure 1-decene. In these cases, the product appears to be dominated by PAO products. The thermal stability of the product increased with the incorporation of diamondoids in the lube product. For a given starting material, increasing diamondoid incorporation improved thermal stability. (Examples 33 and 34). See Tables 7 and 8.

Example 26

Example 26 shows the reaction of 1-decene with $BF_3$—PrOH in the absence of diamondoids. To a 250 mL 4-neck round-bottom flask fitted with a thermocouple, a pressure-equalized addition funnel, a gas dispersion tube, and a reflux condenser having a nitrogen bubbler were added 25 mL (18.5 g) 1-decene, 0.36 g n-propanol, and 48 mL n-hexane. The mixture was heated to 45° C. and stirred magnetically. A small stream of $BF_3$ was introduced via the dispersion tube immersed below the surface of the liquid mixture. After about 10 minutes, additional 100 g of 1-decene was added from the funnel to the flask over 0.5 hour. The temperature of the reaction mixture was 42°–48° C. The mixture was heated at 45°±2° C. for additional 15 hours. Bubbling of a small stream of gaseous $BF_3$ was continued for the first eight hours during this period. Following usual aqueous work-up, 115.5 g of a yellowish product was obtained. The crude product was fractionated using a 12" Vigreux column and a Normag distilling apparatus to remove 35.1 g liquid boiling between 22° C./1.3 mm-Hg and 130° C./0.63 mm-Hg, which contained mostly dimers of decene and a small amount of decenes. The remaining lube range product was 79.3 g yellowish oil. Dimers accounted for 1.7% area in GC in this lube product. It was hydrogenated using $Ni/SiO_2$ catalyst to give a colorless lube.

Example 27

Example 27 demonstrates the reaction of 1-decene with pure adamantane using $BF_3$—PrOH catalyst.

To a 500 mL 4-neck round-bottom flask fitted with a thermocouple, a mechanical stir, a gas dispersion tube, and a reflux condenser having a nitrogen bubbler were added 27.25 g adamantane, 0.90 g n-propanol, and 45 mL n-hexane. A small stream of $BF_3$ was introduced via the dispersion tube immersed below the surface of the reaction mixture. After about 15 minutes, replace the gas dispersion tube with a pressure-equalized addition funnel and 98.19 g of 1-decene was added slowly from the funnel to the flask over 3.3 hours. The temperature of the reaction mixture was maintained between 31°–37° C. After finishing addition, $BF_3$ was reintroduced for additional 15 min. The mixture was heated at 35°±2° C. for about 15 hours. Following usual aqueous work-up, 122.5 g of a yellowish product was obtained. The crude product was fractionated using a 12" Vigreux column and a Normag distilling apparatus to remove about 32 g liquid boiling up to 160° C./0.8 mm-Hg, which contained mostly dimers of decene, monodecyl adamantanes, and small amounts of adamantane and decenes. The remaining lube range product was 89.8 g orange oil. The latter was hydrogenated to give a colorless lube product.

Example 28

Example 28 demonstrates the reaction of 1-decene with diamondoids mixture A using $BF_3$—PrOH catalyst.

To a 500 mL 4-neck round-bottom flask fitted with a thermocouple, a pressure-equalized addition funnel, a gas dispersion tube, and a reflux condenser having a nitrogen bubbler were added 200 g diamondoids mixture A and 0.90 g n-propanol. The mixture was heated to 45° C. and stirred magnetically. A small stream of $BF_3$ was introduced via the dispersion tube immersed below the surface of the liquid mixture. After about 10 minutes, 200 g of 1-decene were added slowly from the funnel to the flask over 0.9 hour. The temperature of the reaction mixture was 42°–49° C. The mixture was heated at 45°±1° C. for additional 20 hours. Bubbling of a small stream of gaseous $BF_3$ was continued for the first eleven hours during this period. Following usual aqueous work-up, 410 g of a yellowish product was obtained (containing a small amount of solvents used during work-up). The crude product was fractionated using a 12" Vigreux column and a Normag distilling apparatus to remove 251 g liquid boiling between 25° C./0.98 mm-Hg and 148° C./0.68 mm-Hg, which contained mostly unreacted diamondoids and small amounts of decenes, decene dimers, and monodecyl diamondoids. The remaining lube range product was 156 g yellowish oil. The latter was hydrogenated using $Ni/SiO_2$ catalyst to give a colorless lube.

To a 600 mL stainless steel autoclave were added 150 g diamondoids mixture A, 150 g of 1-decene, and 0.61 g n-propanol. It was purged with nitrogen to remove air and pressurized with $BF_3$ to 25 psi. The mixture was stirred and heated to 45°–61° C. for 21 hours. The reactor was charged with $BF_3$ periodically to maintain the $BF_3$ pressure between 19–25 psi. Following usual aqueous work-up, 295 g of a yellowish product was obtained. The crude product was fractionated using a 12" Vigreux column and a Normag distilling apparatus to remove 251 g liquid boiling between 28° C./0.4 mm-Hg and 138° C./0.25 mm-Hg, which contained mostly unreacted diamondoids and small amounts of decenes, decene dimers, and monodecyl diamondoids. The remaining lube range product was 121 g of a yellowish oil. The latter was hydrogenated using $Ni/SiO_2$ catalyst to give a colorless lube.

Example 30

Example 30 demonstrates the reaction of the diamondoid Mixture A with gradual addition of 1-decene using $BF_3$—PrOH catalyst under pressure.

General Procedure: To a 600 mL stainless steel autoclave were added 151 g diamondoids (Mixture A) and 0.60 g n-propanol. The mixture was purged with nitrogen to remove air and pressurized with $BF_3$ to 25 psig. The mixture was stirred and heated to 50° C. The $BF_3$ pressure was maintained by refilling. A total of 140 g 1-decene was added by an ISCO pump at a rate of 60 mL/hr. The reaction mixture was heated for an additional period of 13 hrs. Following usual aqueous work-up, 261 g of a dark green oily liquid was obtained. The crude product was fractionated using a 12" Vigreux column and a Normag distilling apparatus to remove 134 g liquid boiling between 32°/0.57 mm-Hg and 150° C./0.72 mm-Hg, which contained unreacted diamondoids, decenes, decene dimers, and monodecyl diamonodoids. The remaining lube range product was 127 g of a dark green oil. The latter was hydrogenated using $Ni/SiO_2$ catalyst to give a colorless lube.

TABLE 7

Reaction of diamondoids with 1-decene catalyzed by $BF_3$—$H_2O$

| Ex. | PrOH | Diamondoids used | | | 1-decene used | | During olefin addn. | | After olefin addn. | | Crude Lube Product | | | |
|---|---|---|---|---|---|---|---|---|---|---|---|---|---|---|
| No. | g | fraction | g | % conv | g | % conv. | Temp. °C. | hrs | Temp. °C. | hrs | g | % yield* | % D-H$^S$ | $Br_2$ # |
| 26 | 0.36 | none | 0.00 | — | 118.5 | 95 | 42–48 | 0.5 | 43–47 | 15 | 79 | 67 | — | 34.3 |
| 27 | 0.90 | adamantane | 27.25 | 90 | 100 | 95 | 31–37 | 3.3 | 33–37 | 15 | 90 | 72 | 20 | — |
| 28 | 0.90 | A↑ | 200 | 19 | 200 | 96 | 42–49 | 0.9 | 44–46 | 20 | 156 | 39 | 9 | — |
| 29 | 0.61 | A↑ | 150 | 24 | 150 | 99 | — | — | 45–61 | 21 | 121 | 40 | 25 | 27.4 |
| 30 | 0.60 | A↑ | 151 | 34 | 140 | 85 | 50–51 | 3.5 | 50 | 13 | 127 | 44 | 34 | 21.3 |

↑Treated with activated alumina to remove colorants first.

TABLE 8

Properties of hydrofinished lube products from $BF_3$—$H_2O$ catalyzed reactions of 1-decene with diamondoids

| Example | Viscosity, cS | | | Pour | | Lube b.p. ≧ | Thermal stability 288° C./72 hr/$N_2$ | |
|---|---|---|---|---|---|---|---|---|
| number | 100° C. | 40° C. | VI | Point °C. | $Br_2$ # | °C./mm-Hg* | % kv 100 change | % weight loss |
| 26 | 4.32 | 20.07 | 125 | <−44.8 | 0.8 | 130/0.63 | −17.1 | 3.6 |
| 27 | 5.37 | 28.84 | 122 | <−48.1 | 0.9 | 160/0.8 | −13.4 | 4.3 |
| 28 | 5.66 | 33.00 | 111 | <−46.4 | 2.3 | 148/0.68 | −9.5 | 8.8 |
| 29 | 6.18 | 38.13 | 108 | <−44.2 | 1.2 | 138/0.25 | −7.6 | 4.9 |
| 30 | 10.66 | 95.62 | 94 | <−42.9 | 1.5 | 150/0.72 | −3.2 | 3.7 |

Example 29

Example 29 demonstrates the reaction of 1-decene with diamondoids mixture A using $BF_3$—PrOH catalysis under pressure.

Examples 31–36

Examples 31–36 illustrated reactions of tricyclo[5.2.1.$0^{2,6}$] decane (tetrahydrodicyclopentadiene, THDC) with 1-decene using Lewis acid catalysis. The results were summarized in Table 8 and 9. Small amounts of THDC was incorporated into the lube products. The products obtained with $AlCl_3$ catalyst were more thermally stable than regular PAO products such as Examples 10 and 12.

General procedure: Fit a 500 mL 4-neck round-bottom flask fitted with a thermocouple, a pressure-equalized addition funnel, a reflux condenser having a nitrogen bubbler, and a stopper. Heat with an oil bath the flask containing tricyclo-[5.2.1.$0^{2,6}$] decane to melt the solid. Then, a Lewis acid catalyst was added. To this mixture was added 1-decene slowly from the funnel with stir over several hours. After finishing addition, the mixture was heated for an additional period. Following usual aqueous work-up, the crude product was fractionated to give crude lube product. The latter was hydrogenated to give final lube product.

TABLE 9

Reaction of hydrogenated cyclopentadiene dimer with 1-decene and aluminum halides

| Example | $AlX_3$ used | Reaction Temp. °C. | THDC:$C_{10}^{=}$ wt. ratio | $C_{10}^{=}$ Conversion | Crude Lube Product % yield | % THDC | Br# |
|---|---|---|---|---|---|---|---|
| 31 | $AlCl_3$ | 67–76 | 1.0:2.6 | ~98 | 67 | ~5 | 14.0 |
| 32 | $AlCl_3$ | ~90–95 | 1.0:2.6 | ~98 | 70 | ~4 | — |
| 33* | $AlCl_3$ | 63–94 | 1.0:2.6 | ~98 | 68 | ~3 | — |
| 35 | $AlCl_3$ | 78–92 | 1.0:1.2 | ~98 | 46 | ~2 | 15.2 |
| 36 | $AlBr_3$ | 93–102 | 1.0:2.6 | ~98 | 62 | ~2 | — |

*Has an extended period for the isomerization of THDC before adding 1-decene

TABLE 10

Properties of hydrofinished THDC-modified PAO's

| Example | Viscosity, cS 100° C. | 40° C. | VI | pp °C. | Br number | Thermal stability 288° C./72 hr hr/$N_2$ % kv 100 change | % wt loss |
|---|---|---|---|---|---|---|---|
| 34¶ | 30.06 | 286.0 | 143 | −42.2 | 2.8 | −19.6 | 3.1 |
| 35 | 15.18 | 118.20 | 134 | <−48.4 | 2.6 | −22.8 | 1.9 |
| 36 | 16.90 | 130.47 | 141 | <−45.6 | 1.9 | −39.4 | 1.7 |

This was the combined samples from Examples 35–37.

Oxidative stability of the products

Oxidative stability of the products were assessed using two methods after blending the hydrofinished lube with anti-oxidants and other components. One method used was induction period (IP) method employing high pressure DSC. In this method, a few mg of the sample was place in an open Al pan in the DSC. The apparatus was filled with oxygen to 500 psi. The temperature of the sample was increased from 40° to 185° C. at 50° C./min and was held at 185° C. for an additional 80 min. The induction period was defined as the time required to reach 10% of the eventual exotherm peak height for each sample. The reported numbers include averages of several runs. The samples were also tested for oxidative stability with air sparge at 325° F. for 72 hours. The results are shown in the table below. Both method show that the oxidative stability of the diamondoid-containing lube is comparable to the regular PAO type lubricants such as Examples 10 and 12.

Oxidative stability of diamondoid-modified PAO

| Example | DSC IP, min | sludge | Oxidative Stability Test results at 325° F./72 hrs. % change in 100° C. Viscosity | acid # mgKOH | % Pb loss |
|---|---|---|---|---|---|
| 1 | 48.7 | light | 6.52 | 0.37 | 0.69 |
| 2 | 43.1 | light | 5.08 | 0.15 | 0.89 |
| 3 | 48.8 | light | 4.30 | 0.17 | 0.72 |

-continued

Oxidative stability of diamondoid-modified PAO

| Example | DSC IP, min | sludge | Oxidative Stability Test results at 325° F./72 hrs. % change in 100° C. Viscosity | acid # mgKOH | % Pb loss |
|---|---|---|---|---|---|
| 4 | 45.1 | light | 6.63 | 0.05 | 0.25 |
| 5 | 50.5 | light | 5.38 | 0.22 | 0.00 |
| 6 | 49.5 | light | 6.65 | 0.13 | 0.72 |
| 7 | 48.2 | light | 4.51 | 0.25 | 0.44 |
| 8 | 52.7 | light | 4.65 | <0.05 | 0.65 |
| 9 | 56.7 | moderate | 5.32 | — | 0.62 |
| 10 | 49.4 | light | 3.09 | <0.05 | 0.81 |
| 12 | 48.1 | light | 9.54 | 0.25 | 2.27 |

Changes and modifications in the specifically described embodiments can be carried out without departing from the scope of the invention which is intended to be limited only by the scope of the appended claims.

What is claimed is:

1. A lubricant composition comprising alkyl-substituted diamondoids containing more than one added alkyl group having at least about 6 carbon atoms, wherein the ratio of linear to branched added alkyl substituents is at least about 1:1, and wherein the average number of alkyl substitutions per diamondoid molecule is from about 1.5 to about 4, which lubricant composition is characterized by a Bromine Number of less than about 13.

2. The lubricant composition of claim 1 wherein the ratio of linear to branced added alkyl substituents is at least about 4:1.

3. The lubricant composition of claim 1 wherein the average number of alkyl substitutions per diamondoid molecule is from about 1.7 to about 3.3.

4. The lubricant composition of claim 3 wherein the average number of alkyl substitutions per diamondoid molecule is from about 2 to about 3.

5. The lubricant composition of claim 1 further characterized by a Bromine Number of less than about 5.

6. A lubricant composition comprising alkyl-substituted adamantanes containing more than one added alkyl group having at least about 6 carbon atoms, wherein the ratio of linear to branched added alkyl substituents is at least about 1:1, and wherein the average number of alkyl substitutions per diamondoid molecule is from about 1.5 to about 4, which lubricant composition is characterized by a Bromine Number of less than about 13.

7. The lubricant composition of claim 6 wherein the ratio of linear to branced alkyl substituents is at least about 4:1.

8. The lubricant composition of claim 6 wherein the average number of alkyl substitutions per diamondoid molecule is from about 1.7 to about 3.3.

9. The lubricant composition of claim 8 wherein the average number of alkyl substitutions per diamondoid molecule is from about 2 to about 3.

10. The lubricant composition of claim 6 further characterized by a Bromine Number of less than about 5.

11. The lubricant composition of claim 6 further comprising a synthetic lubricant stock containing polyalphaolefins.

12. The lubricant composition of claim 11 consisting essentially of alkyl-substituted diamondoids containing more than one added alkyl group having at least about 6 carbon atoms, wherein the ratio of linear to branched added alkyl substituents is at least about 1:1, and wherein the average number of alkyl substitutions per diamondoid molecule is from about 1.5 to about 4.

* * * * *

UNITED STATES PATENT AND TRADEMARK OFFICE

CERTIFICATE OF CORRECTION

PATENT NO. : 5,367,097

DATED : November 22, 1994

INVENTOR(S) : D-M Shen and M. M. Wu

It is certified that error appears in the above-indentified patent and that said Letters Patent is hereby corrected as shown below:

Column 18, line 6, claim 12, change dependency from "Claim 11" to --Claim 1--.

Signed and Sealed this

Fourteenth Day of March, 1995

*Attest:*

*Attesting Officer*

Bruce Lehman

BRUCE LEHMAN

*Commissioner of Patents and Trademarks*